United States Patent [19]

MacKay, Jr.

[11] Patent Number: 4,979,336

[45] **Date of Patent: * Dec. 25, 1990**

[54] DISPOSABLE FINISHING ARTICLE HAVING AN INTEGRAL MOUNTING HUB INCLUDING AN IMPROVED METAL PRESSURE CAP

[76] Inventor: Joseph H. MacKay, Jr., 17551 Cabela Dr., San Diego, Calif. 92127

[ * ] Notice: The portion of the term of this patent subsequent to Jul. 5, 2005 has been disclaimed.

[21] Appl. No.: 355,213

[22] Filed: May 22, 1989

Related U.S. Application Data

[63] Continuation-in-part of Ser. No. 212,448, Jun. 28, 1988, Pat. No. 4,924,634, which is a continuation-in-part of Ser. No. 5,812, Jan. 21, 1989, Pat. No. 4,760,670, which is a continuation-in-part of Ser. No. 847,793, Apr. 3, 1986, Pat. No. 4,694,615.

[51] Int. Cl.[5] ..... B24B 45/00

[52] U.S. Cl. ..... 51/168; 51/209 R; 51/378; 15/230.18

[58] Field of Search ..... 51/168, 209 R, 358, 51/376, 377, 378, 389; 15/230.18, 230.19

[56] References Cited

U.S. PATENT DOCUMENTS

| | | | |
|---|---|---|---|
| 872,932 | 12/1907 | Hall | 51/168 |
| 3,136,100 | 6/1964 | Robertson, Jr. | 51/209 R |
| 3,623,281 | 11/1971 | Moffat | 51/377 |
| 3,879,178 | 4/1975 | Bosma | 51/168 |
| 4,015,371 | 4/1977 | Grayston | 51/168 |
| 4,439,953 | 4/1984 | Block et al. | 51/389 |
| 4,449,329 | 5/1984 | Sauerwein et al. | 51/168 |
| 4,754,577 | 7/1988 | MacKay, Jr. | 51/168 |
| 4,794,737 | 1/1989 | Timmons et al. | 51/168 |

*Primary Examiner*—Robert A. Rose

*Attorney, Agent, or Firm*—Nilsson, Robbins, Dalgarn, Berliner, Carson & Wurst

[57] ABSTRACT

A disposable finishing article for mounting on a rotatable threaded spindle of a power tool. The finishing article contains a retaining nut on one side and a backing flange on the other non-removably secured together on the finishing article without the aid of adhesives in such a manner that the finishing article is placed in compression when it is operably secured upon the spindle of the power tool under operative loads. The nut and flange are secured together by upsetting one end of the nut causing it to protrude outwardly over the outer surfaces of the flange. A metal pressure cap member is secured to the backing flange by a plurality of fingers formed on the backing flange for engaging a shoulder formed on the spindle of the power tool during operation of the finishing article.

7 Claims, 2 Drawing Sheets

DISPOSABLE FINISHING ARTICLE HAVING AN INTEGRAL MOUNTING HUB INCLUDING AN IMPROVED METAL PRESSURE CAP

RELATED APPLICATION

This application is a continuation-in-part of U.S. patent application Ser. No. 212,448 filed June 28, 1988 for FINISHING ARTICLE HAVING AN INTEGRAL MOUNTING HUB AND IMPROVED BASE, now U.S. Pat. No. 4,924,634, which is a continuation-in-part of U.S. patent application Ser. No. 005,812, filed Jan. 21, 1987 for DISPOSABLE DEPRESSED CENTER GRINDING WHEEL HAVING AN INTEGRAL MOUNTING HUB, now U.S. Pat. No. 4,760,670 which is a continuation-in-part of U.S. patent application Ser. No. 847,793, filed Apr. 3, 1986 for DISPOSABLE DEPRESSED CENTER GRINDING WHEEL HAVING AN INTEGRAL MOUNTING HUB, now U.S. Pat. No. 4,694,615.

FIELD OF THE INVENTION

This invention relates generally to finishing articles and more particularly to such articles having a mounting hub permanently affixed thereto with the combination adapted for quick attachment and release to an appropriate portable power tool.

BACKGROUND OF THE INVENTION

The use of rotatably driven finishing articles is widespread and familiar in our industrial society. One of the more serious problems encountered in the use of such devices resides in the provision of effective means for preventing undesired or accidental disassociation of the article from the shaft, spindle or other rotatable drive means on which it is mounted. This problem is particularly acute when the connection between the article and its driving shaft or spindle is intentionally detachable to facilitate quick removal and replacement of the article. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the depressed center abrasive grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly, however, typically requires appropriate tools such as wrenches or the like to remove the grinding wheel from the drive shaft. Such a device is shown in U.S. Pat. Nos. 489,149; 3,596,415; 1,998,919; 566,883; 507,223; 1,162,970; 791,159; 489,149 and 3,210,892.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 3,136,100; 4,015,371; 2,278,301; 3,081,584; 3,500,592; 3,800,483; 4,240,230 and 4,541,205.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,322,920; 4,439,953; 4,449,329; 4,601,661; 791,791; 872,932; 2,567,782; 3,136,100, 3,210,892 and 3,621,621.

The devices utilized in the prior art for providing the disposable finishing article assembly including the permanent affixed mounting hub generally provide the service intended. There are certain inherent disadvantages found with regard to the various devices. Such disadvantages are that in manufacturing the utilization of an adhesive adds additional labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the finishing article as it is being rotated by the power tool. Furthermore, such die-cast mounting hubs are relatively bulky, take up space and add substantial weight and additional cost to the completed product.

SUMMARY OF THE INVENTION

A finishing article having a drive member non-removably affixed thereto for mounting on a rotatable spindle of a power tool. The drive member includes a backing flange having gripping fingers radially inwardly extending therefrom secured by a retaining nut positioned on the opposite side from the backing flange. The retaining nut extends through an opening in the finishing article from the face toward the back of the finishing article and has a radial flange at one end thereof seated against the finishing article face and protrusion means extending outwardly from the other end thereof for non-removably securing the retaining nut and the backing flange together on the finishing article without the use of adhesives. A truncated conically shaped metal pressure cap defining a central opening is loosely held in place by the gripping fingers on the backing flange and extends longitudinally away from the backing flange to engage the power tool spindle seat for placing the abrasive finishing article in compression during use thereof when the finishing article is operatively secured upon the spindle of the power tool.

DETAILED DESCRIPTION

Figure 1:
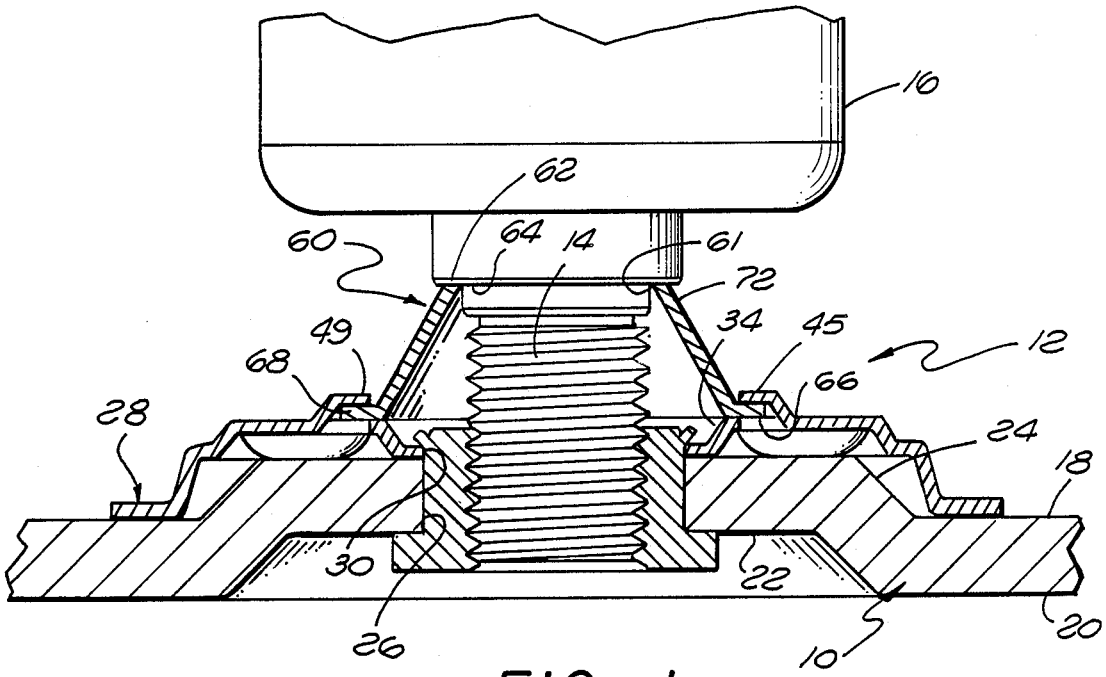
FIG. 1 is a cross sectional view of a finishing article assembly constructed in accordance with the principles of the present invention and mounted in operable position on the spindle of a power tool.

By reference now to FIGS. 1 through 6, there is illustrated a preferred embodiment of a disposable finishing article drive member assembly constructed in accordance with the principles of the present invention. The finishing article constructed in accordance with the present invention may take many forms, such, for example, as grinding wheels, flap wheels, wire wheels, abrasive disks or pads, or the like. For purposes of ease of illustration and clarity of description only a depressed center grinding wheel will be shown and described. It will, however, be understood by those skilled in the art that other disposable finishing articles which may be placed in compression during use thereof may be substituted for the grinding wheel. As is shown in FIGS. 1 through 6, a depressed center grinding wheel 10 has a disposable drive member or hub assembly 12 permanently affixed thereto without the use of adhesives so that the grinding wheel may be attached to the threaded spindle 14 of an appropriate power tool 16. According to the principles of the present invention, a disposable mounting hub or drive member is constructed in such a manner that when the grinding wheel is placed in operation upon the spindle 14 the grinding wheel 10 is placed in compression and the more force that is applied to the grinding wheel during utilization thereof, the greater the operational compression becomes. As a result of placing the grinding wheel in such compression the grinding wheel is maintained upon the spindle and at the same time, through the compression or clamping force, the grinding wheel 10 cannot rotate relative to the drive member or hub assembly 12. However, as a result of the construction of the drive member, the spent grinding wheel may be easily removed from the spindle for disposal without the utilization of hand tools or the like.

As is clearly shown, the grinding wheel 10 includes a back surface 18 and a front surface 20. The central portion of the grinding wheel is depressed as viewed from the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the driving member or spindle does not protrude beyond the face portion 20 of the wheel 10 and thus interfere with a workpiece during the time the grinding wheel 10 is being utilized. However, when certain types of finishing articles are utilized such that the outer circumference is used instead of the face, then a depressed center may not be necessary or included in the article.

A backing flange 28 is provided and is adapted to be snugly received on the back surface 18 of the grinding wheel 10 about the raised portion 24. The flange 28 has a diameter which is less than the diameter of the wheel 10. The backing flange 28 defines a second central aperture 30 therethrough which is aligned with the aperture 26 in the grinding wheel 10. Reinforcing ribs 32 and 34 are formed in the backing flange 28 concentrically with the opening 30. The backing flange 28 is preferably stamped from sheet metal. Also provided are radially disposed reinforcing ribs 27, 29, 31 and 33 extending between the concentric ribs 32 and 34.

Figure 3:
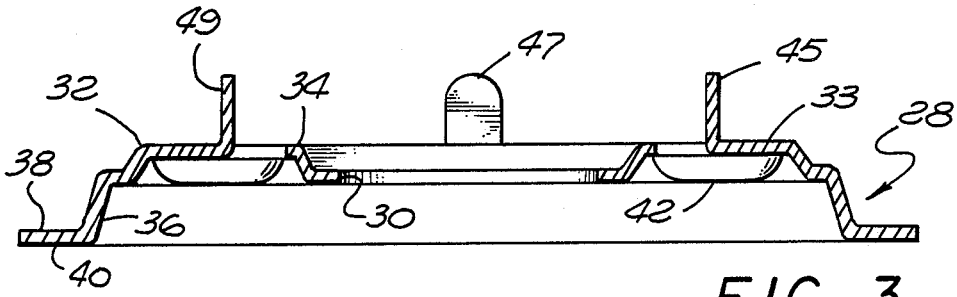
FIG. 3 is a cross sectional view taken about the lines 3—3 in FIG. 2 of a backing flange constructed in accordance with the present invention.

As is shown more specifically in FIG. 3, the backing flange 28 includes an inner surface 36 and an outer surface 38. The inner surface 36 is disposed opposed the back surface 18 of the abrasive finishing wheel 10. The inner surface 36 includes lands 40 and 42. The land 40 is formed about the outer peripheral portion of the backing flange 28. The land 42 is displaced inwardly toward the opening 30 and away from the land 40. The land 40 always engages the back surface 18 of the abrasive finishing wheel away from the depressed center while the land 42 may engage the back surface of the abrasive finishing wheel 10 opposed the depressed center 22 thereof depending upon variations in wheel dimensions and manufacturing tolerances in the wheels and flanges.

Figure 2:
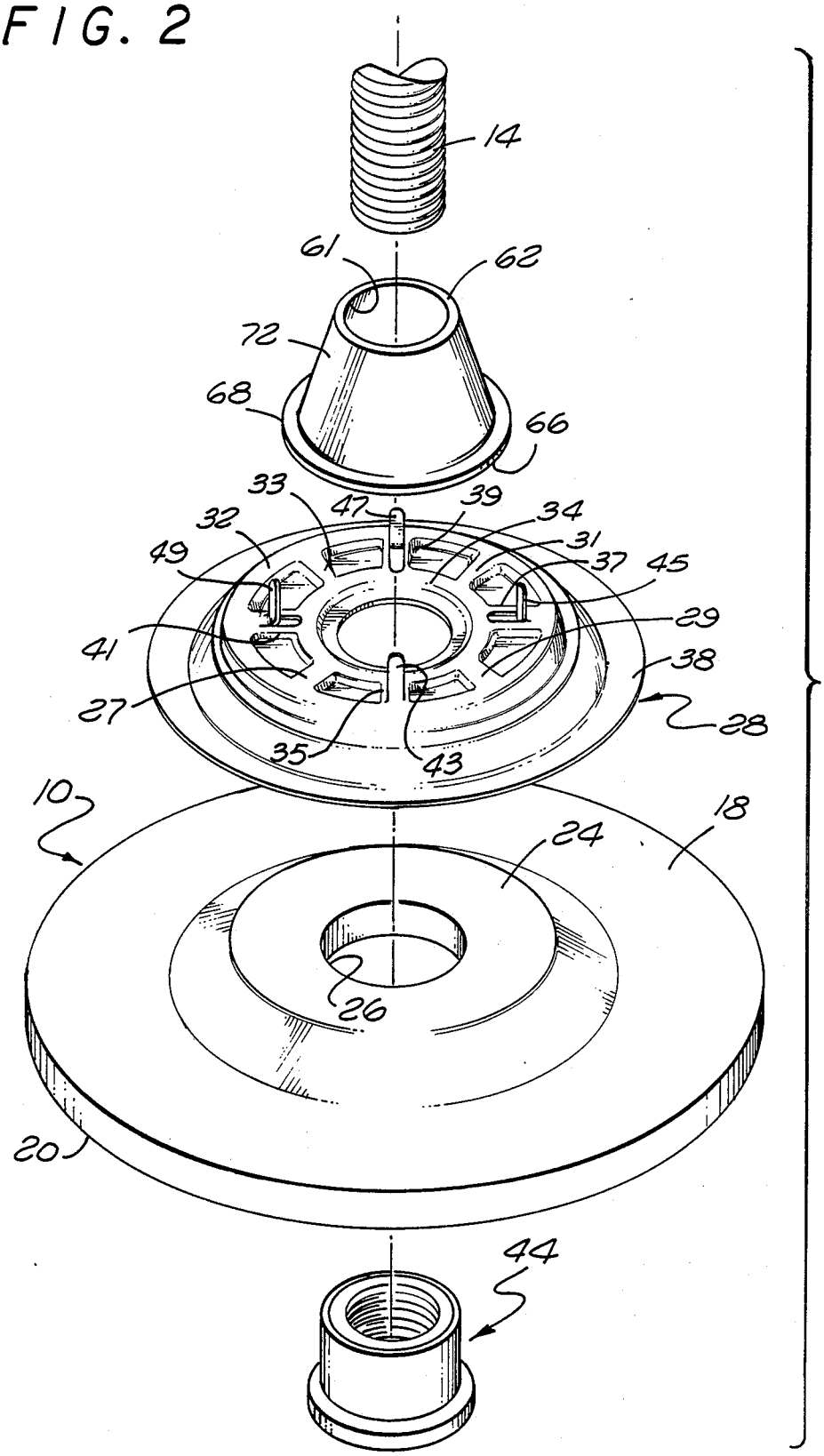
FIG. 2 is an exploded view of the structure as illustrated in FIG. 1.

As can be seen, particularly in FIGS. 2 and 3, the ribs 32 and 34 formed in the outer surface 38 of the backing flange 28 are continuous. The continuous rib 32 is disposed between the lands 40 and 42 and over the transitional area between the depressed center and the remainder of the grinding wheel 10 while the continuous rib 34 is disposed intermediate the opening 30 and the land 42. The radially disposed ribs 27, 29, 31, 33, 37 and 39 extend between the continuous ribs 32 and 34 to provide more stiffness to the backing flange in heavy grinding operations. The radially disposed ribs 35, 37, 39 and 41 have gripping means such as a plurality of fingers 43, 45, 47 and 49 formed therein. Preferably, when the backing flange 28 is fabricated from stamped sheet metal the fingers 43, 45, 47 and 49 may be formed by cutting or punching the sheet metal during the stamping operation. The purpose and function of the gripping fingers will be described herein after.

Figure 4:
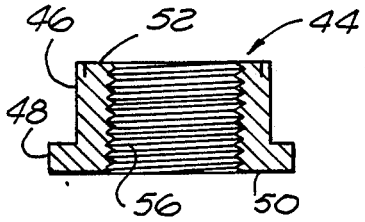
FIG. 4 is a cross sectional view of a retaining nut constructed in accordance with the principles of the present invention.

As shown in FIG. 4, a retainer nut 44 includes a body portion 46 which is hollow and has a radially outwardly extending flange 48 at a first end 50 thereof. The internal surface of the body 46 has threads 56 formed therealong for attachment to the threaded spindle 14 of the power tool. The nut 44 is inserted through the aperture 26 in the grinding wheel and the aperture 30 in the flange 28 from the front surface 20 toward the rear surface 18 of the grinding wheel 10. The end 52 of the nut 44 extends through the opening 30 in the flange 28.

The nut 44 is preferably constructed from an aluminum extrusion which is then machined to provide the flange 48 and the threads 46. Alternatively the nut may be formed from aluminum or steel bar stock, or a metal die casting, or molded plastic.

Figure 5:
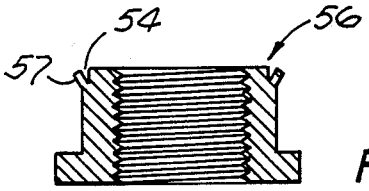
FIG. 5 is a cross sectional view of the retaining nut of FIG. 5 after being upset.

Once the nut 44 has been inserted through the openings in the wheel 10 and the flange 28, the end 52 thereof is upset such as by a staking operation to provide a protrusion 56 extending outwardly therefrom as shown specifically in FIG. 5. The protrusion may be formed as a series of separate protrusions, or, as shown, as a continuous protrusion. Preferably the protrusion is formed by staking operation which forms a continuous groove 54 in the end of 52 of the nut 44. Formation of the groove 54 causes the displaced material to form a lip or overhang 57 which will overlie the back of the backing flange 28 about the opening 30 therethrough. It should become apparent to those skilled in the art that the flange 28 and the nut 44 are secured together on the wheel 10 between the flange 48 and the overhang 57 without the use of adhesives.

To provide proper operational compressive forces of the throwaway grinding wheel as above-described, a pressure cap 60 is loosely held in engagement with the hub assembly 12. The metal pressure cap 60 is formed as a truncated conically shaped member having a hollow body 72. A radially outwardly extending gripping rib 68 is formed at the base of the frusto conically. Preferably the metal pressure cap 60 is formed from sheet metal using progressive dies, however, it will be recognized that the frusto conical body 72 may be formed by metal die casting as well. The metal pressure cap 60 includes a first or rear surface 62 for engaging a surface 64 on the power tool spindle when the grinding wheel is in an operable position on the power tool 16. A second or front surface 66 on the metal pressure cap 60 contacts the top of the continuous rib 34. The metal pressure cap 60 is retained in position on the hub assembly 12 by the gripping rib 68 which extends radially outwardly from the base of the metal pressure cap 60. The fingers 43, 45, 47 and 49 are bent over once the surface 66 engages the continuous rib 34 on the flange 28 and become radially inwardly directed to loosely secure the metal pressure cap 60 to the flange 28. Once installed, the metal pressure cap 60 remains on the grinding wheel 10 and is disposed of along with the spent wheel 10. The hollow body 72 of the metal pressure cap 60 defines an aperture 61 for receiving the spindle 14 of the power tool. When assembled on the backing flange 28 the apertures 26, 30 and 61 are aligned axially. These locating tabs would usually be at least three in number and would serve to positively position the cap 60 with respect to the spindle 14 in all instances where such may be necessary or desired. As will be noted, when the grinding wheel is in use on the power tool compressive forces are transmitted in a substantially straight line along a plane formed through the side wall of the body 72 of the pressure cap 60 between the surfaces 62 and 66. It is particularly noteworthy that there are no curved surfaces where deformation may occur by unusually large forces created during grinding.

The force necessary to cause the grinding wheel 10 to be placed in compression is generated upon attachment of the spindle 14 to the threads 56 in the nut 44. By reference to FIG. 1 it will be noted that when the grinding wheel is threaded upon the spindle 14 the surface 62 engages the spindle seat 64. The interengagement between the threads 14 and 56 of the spindle and nut, respectively, urge the nut upward toward the flange 28 as the wheel is seated upon the spindle. At the same time, the spindle seat 64 applies a downward force to surface 62 of the pressure cap 60 which in turn, through the surface 66 applies a downward force to the flange 28. Therefore, this mutual clamping force causes the grinding wheel to be placed in compression. Those skilled in the art will recognize that as the grinding wheel 10 is used by being placed against a workpiece, additional torque is applied causing the grinding wheel to be further tightened onto the spindle 14. That is, as the grinding wheel moves during contact with a workpiece, the friction between the nut and the grinding wheel center causes the nut to rotate in a further tightening direction. Such rotation of the nut further urges the nut toward the flange which in turn applies a further force to the flange. The more the grinding wheel is tightened the greater the operational compression force becomes and the more securely the grinding wheel 10 is clamped between the backing flange 28 and the flange 48 on the nut 44. As a result of this strong clamping or compression the grinding wheel 10 is precluded from movement relative to the hub or driving member 12 and at the same time is precluded from disengaging from the spindle 14. It will be recognized by those skilled in the art that the grinding wheel assemblies as illustrated in FIGS. 1 through 5 and as above described require no adhesive for construction and may be simply and easily assembled, are relatively light in weight as compared to the prior art devices utilizing the cast hubs and provides a secure attachment of the abrasive finishing article to the power tool and through the utilization of the increased compression precludes relative rotation of the grinding wheel with respect to the driving member. It has also been discovered that the utilization of the device as above described and as constructed in the preferred embodiment is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

Figure 6:
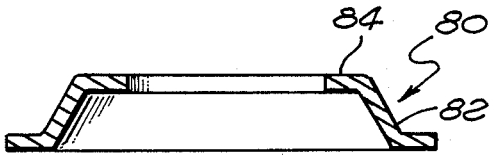
FIG. 6 is a cross sectional view of a metal pressure cap for use on small diameter finishing articles.

The pressure cap 80 illustrated in FIG. 6 is identical in structure and function as that shown in FIGS. 1 and 2 except that the body 82 is shorter and the surface 84 is enlarged inwardly. These structural changes accommodate use with small diameter finishing articles which are traditionally used on mini power tools.

It should be understood by those skilled in the art that the pressure cap, 60 or 80, may be held loosely in place by forming indentations or openings in the body of the cap into or through which the fingers would protrude.

Through the structures as illustrated and described, all currently known sizes of standard diameter depressed center grinding wheels, namely four inch, four and one half inch, five inch, seven inch and nine inch may be accommodated. At the present time, through the utilization of the die-cast integral hub-flange structure, only seven and nine inch grinding wheels utilize the throw away hub while the four, four and one half and five inch wheel utilize the conventional two-piece mounting set traditional in the prior art and as above described.

There has thus been disclosed a disposable finishing article driving member assembly which securely holds the article during operation, which is light in weight, vibration-free, and less expensive than prior art throwaway articles while meeting all safety standards currently known and in existence.

What is claimed is:

1. A finishing article having a disposable drive member non-removably affixed thereto for mounting on a threaded rotatable spindle of a power tool comprising:

a finishing article having a face and a back and having a first centrally disposed aperture therethrough;

a backing flange having an inner and outer surface and diameter smaller than the diameter of said finishing article with said inner surface seated on said back of said article; said backing flange defining a second centrally disposed aperture therethrough, and gripping fingers extending radially inwardly from said outer surface thereof; said first and second apertures being aligned;

a retaining nut having a hollow internally threaded body having first and second ends and a first radially outwardly extending flange extending from said first end of said body, said body extending through said first and second apertures from said face toward said back with said radial flange seated against said face; and means protruding outwardly from said second end of said body to non-removably secure said retaining nut and said backing flange together on said wheel without the use of adhesives; and a metal pressure cap defining a centrally disposed opening therethrough held loosely in place on said flange by said fingers extending radially inwardly from said backing flange to apply force to said backing flange when said finishing article is secured on said spindle to cause said backing flange and said retaining nut to move toward each other to compress said finishing article therebetween as operative loads are applied to said article during use on said power tool.

2. A finishing article as defined in claim 1 wherein said metal pressure cap further includes a radially outwardly extending gripping rib which is engaged by said fingers to hold said cap in place on said flange.

3. A finishing article as defined in claim 2 wherein said metal pressure cap further includes a cap body having a frusto conical shape with said gripping rib extending radially outwardly from a base thereof.

4. A finishing article as defined in claim 3 wherein said metal pressure cap body includes a first surface for engaging said spindle and a second surface for engaging said backing flange when said metal pressure cap is secured to said wheel.

5. A finishing article as defined in claim 4 wherein said outer surface of said backing flange includes a reinforcing rib extending therefrom and wherein said second surface of said metal pressure cap engages said reinforcing rib.

6. A finishing article as defined in claim 5 wherein said cap body includes a side wall defining a substantially straight plane between said first and second surfaces along which said force is applied.

7. A finishing article as defined in claim 6 wherein said backing flange includes radially extending reinforcing ribs formed therein, said gripping fingers are formed in said radial ribs and said metal pressure cap is secured to said flange by bending said fingers over said gripping rib.

* * * * *